US009908126B2

(12) United States Patent
Gompper et al.

(10) Patent No.: US 9,908,126 B2
(45) Date of Patent: Mar. 6, 2018

(54) SPRAY HEAD FOR A PRE-RINSE ASSEMBLY

(71) Applicants: Brion Gompper, Lakewood, NJ (US); Varanjitsinh Chudasama, Toms River, NJ (US)

(72) Inventors: Brion Gompper, Lakewood, NJ (US); Varanjitsinh Chudasama, Toms River, NJ (US)

(73) Assignee: COMPONENT HARDWARE GROUP, INC., Lakewood, NJ (US)

( * ) Notice: Subject to any disclaimer, the term of this patent is extended or adjusted under 35 U.S.C. 154(b) by 572 days.

(21) Appl. No.: 14/550,495

(22) Filed: Nov. 21, 2014

(65) Prior Publication Data

US 2015/0174593 A1 Jun. 25, 2015

Related U.S. Application Data

(60) Provisional application No. 61/919,096, filed on Dec. 20, 2013.

(51) Int. Cl.

| | |
|---|---|
| ***B05B 1/14*** | (2006.01) |
| ***B05B 1/08*** | (2006.01) |
| ***B05B 3/04*** | (2006.01) |

(52) U.S. Cl.

CPC . *B05B 1/14* (2013.01); *B05B 3/04* (2013.01)

(58) Field of Classification Search

CPC .... B05B 1/18; B05B 3/04; B05B 1/08; B05B 1/083

USPC ..... 239/380–383, 463, 464, 468, 469, 490, 239/491, 492, 562, 563

See application file for complete search history.

(56) References Cited

U.S. PATENT DOCUMENTS 5,356,077 A * 10/1994 Shames ..... B05B 1/1645 239/383

6,533,194 B2 * 3/2003 Marsh ..... B05B 1/1645 239/381

* cited by examiner

*Primary Examiner* — Christopher Kim

(74) *Attorney, Agent, or Firm* — Francis C. Hand; Carella, Byrne, Et Al

(57) ABSTRACT

The spray head for a pre-rinse assembly includes a discharge cover having a plurality of ports for discharging water and a diffuser within discharge cover having a circumferential wall with at least one slot for directing a jet of water onto the fins of a rotatable impeller within the diffuser. The impeller has a plurality of tabs disposed relative to the ports whereby a respective tab momentarily covers a respective port to prevent passage of water therethrough during rotation of said impeller thereby effecting a pulsating stream of water through a respective port.

21 Claims, 4 Drawing Sheets

SPRAY HEAD FOR A PRE-RINSE ASSEMBLY

This Non-Provisional Application claims the benefit of Provisional Patent Application 61/919,096, filed Dec. 20, 2013.

This invention relates to a pre-rinse spray head for a pre-rinse assembly. More particularly, this invention relates to a low flow pre-rinse spray head for a pre-rinse assembly.

As is known, various types of pre-rinse spray head assemblies have been employed for the rinsing and washing of dishes, utensils, pots, pans and the like in sinks in commercial and institutional establishments. Typically, water is delivered from a tap to a flexible hose to a spray head assembly which can be manipulated by a user to direct multiple sprays of water into an area of the sink in which spray water is required. Usually, the water is delivered via a manually operated hand valve in the spray head assembly. Typically, the spray head assemblies that have been employed consume approximately 3 gallons of water per minute at a standard pressure of 60 psi.

It is an object of this invention to minimize the water consumption of a pre-rinse spray head assembly.

It is another object of the invention to produce streams of water at high velocity from a pre-rinse spray head assembly.

It is another object of the invention to produce pulsating streams of water at high velocity from a pre-rinse spray head assembly.

Briefly, the invention provides a pre-rinse spray head that produces pulsating streams of water for pre-rinsing purposes.

The spray head includes a discharge cover having a plurality of circumferentially disposed ports for discharging water therethrough, an impeller rotatably mounted within the cover and means within the cover for directing at least one jet of water onto the impeller to effect rotation of the impeller within the cover and for subsequent passage out of ports as a jet of water.

The impeller has a plurality of circumferentially disposed fins for impingement of the jet of water thereon to cause rotation of the impeller. In addition, the impeller has a plurality of tabs disposed circumferentially thereof and transverse to the fins in facing relation to the ports in the discharge cover. During use, the impeller is rotated by the jet of water impinging on the fins and each tab passes over a respective port to momentarily cover the port to prevent passage of water therethrough thereby effecting a pulsating stream of water through each port.

The tabs of the impeller are also disposed relative to the ports in the discharge cover so that as one tab covers a port to prevent passage of water therethrough during rotation of the impeller, the other tabs are spaced from the other ports to allow passage of water therethrough. Thus, the streams of water are pulsed from each port in a staggered manner.

The means within the cover for directing at least one jet of water onto the Impeller includes a diffuser that is secured to and concentrically within the discharge cover to surround the impeller.

In one embodiment, the diffuser is cup-shaped with a base spaced from the discharge cover and a circumferential wall extending from the base and abutting the discharge cover. This wall has at least one slot that extends angularly therethrough for directing a jet of water therethrough into the diffuser and onto the impeller.

In another embodiment, the diffuser has a circumferential wall with a plurality of slots for directing multiple jets of water onto the impeller.

In one embodiment, the spray head has a housing with an inlet for a flow of water that is abutted against the discharge cover to house the diffuser and impeller therein. In this embodiment, the diffuser is disposed in the housing with the base defining a transverse chamber with the housing and in communication with the inlet for receiving the flow of water and with the circumferential wall defining an annular chamber with the housing and in communication with the transverse chamber to receive the flow of water.

In this embodiment, the discharge cover may have three ports while the impeller has three tabs whereby two pulsating streams of water are discharged from the spray head at all times during operation.

In another embodiment, the spray head has a retainer with an inlet for a flow of water spaced from the discharge cover by an annular rubber bumper that is secured between the retainer and discharge cover in sealed relation thereto while projecting therefrom. In this embodiment, the diffuser is disposed coaxially between the retainer and discharge cover with the base defining a transverse chamber with the retainer and in communication with the inlet for receiving the flow of water and with the circumferential wall defining an annular chamber with the discharge cover and in communication with said transverse chamber to receive the flow of water.

In this embodiment, the discharge cover may have three ports while the impeller has two tabs whereby two streams of water are discharged from the spray head at all times during operation. Alternatively, the discharge cover may have two ports and impeller two tabs whereby one pulsating stream of water is discharged from the spray head at all times during operation of the spray head.

Further, the discharge cover may have a plurality of inserts with each insert being disposed in a respective one of the ports and having an orifice for discharging a jet of water.

The pulsating streams of water provided by the spray head are sufficient to effectively pre-rinse dishes, plates and similar china. In this regard, depending on the delivered rate of flow, the spray head is able to deliver a pulsating spray of water of less than 1.2 gallons per minute.

These and other objects of the invention will become more apparent from the following detailed description taken in conjunction with the accompanying drawings wherein.

Figure 1:
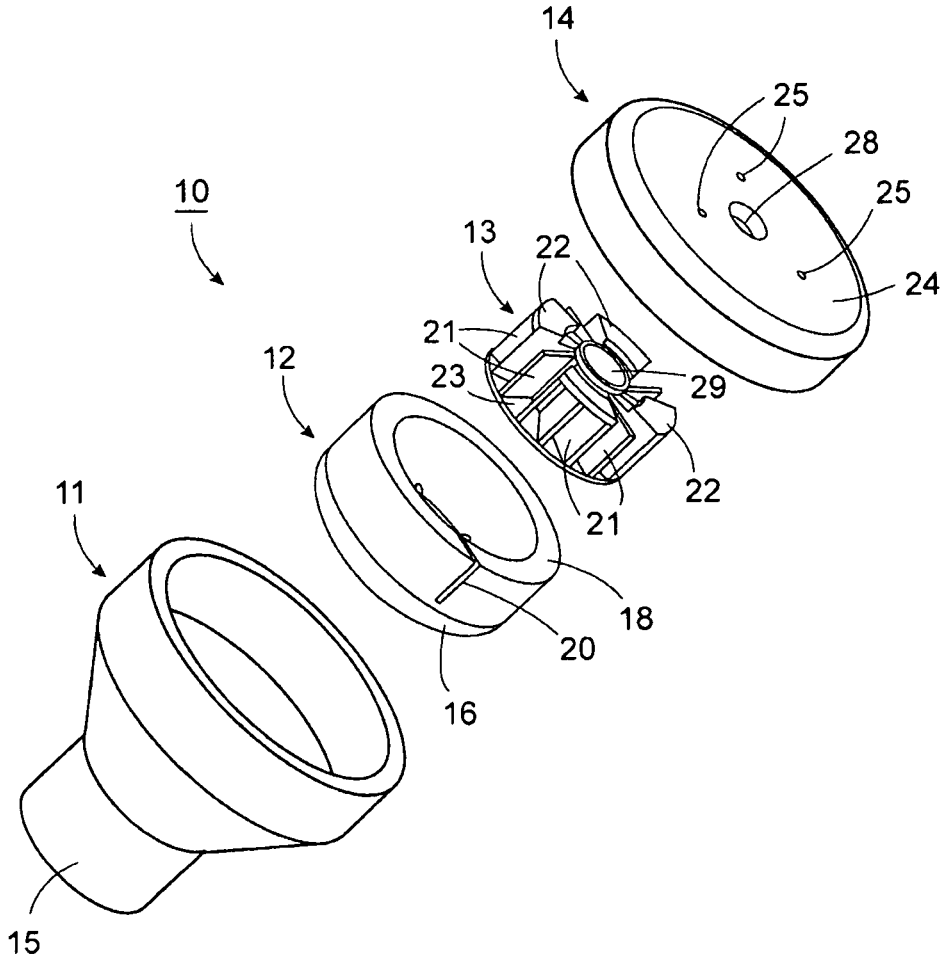
FIG. 1 illustrates an exploded view of a spray head constructed in accordance with the invention.

Referring to FIG. 1, the spray head 10 for a pre-rinse assembly comprises four basic parts, i.e. a housing 11, diffuser 12, impeller 13 and discharge cover 14 and is constructed to be used in a spray head assembly (not shown) such as illustrated in U.S. Pat. No. 5,624,074.

The housing 11 is made in one piece of a plastic material (or of a metal) and has an inlet 15 at one end to receive a flow of water from a hose (not shown) of the pre-rinse assembly for example, via a hand-held valve.

The diffuser 12 is fixedly disposed in the housing 11 by being secured to the cover 12 on a longitudinal axis of the housing 11 and is made in one piece of a suitable material, such as a metal, plastic or composite.

Figure 2:
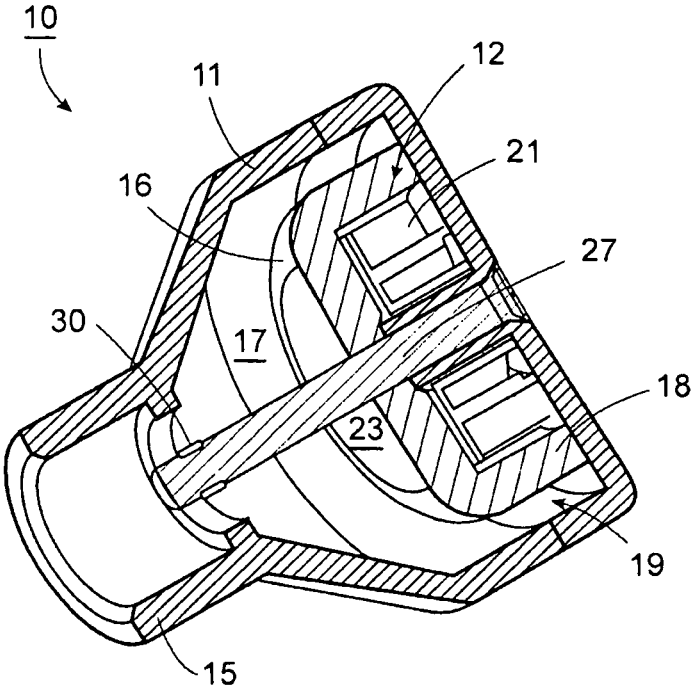
FIG. 2 illustrates a perspective view of the spray head of FIG. 1.

Referring to FIG. 2, the diffuser 12 has a base 16 disposed in the housing 11 to define a transverse chamber 17 therebetween in communication with the inlet 15 for receiving the flow of water and a circumferential wall 18 extending from the base 16 to define an annular chamber 19 therebetween in communication with the transverse chamber 17 to receive the flow of water. The diffuser 12 is cup-shaped and is fixed to the cover 14 such that water passing from the inlet 15 flows around the diffuser 12 from the transverse chamber 17 to the annular chamber 19.

Referring to FIG. 1, the circumferential wall 18 of the diffuser 12 has a slot 20 extending angularly therethrough that is in communication with the annular chamber 19 to direct a jet of water therethrough and onto the impeller 13 in order to drive the impeller 13.

The impeller 13 is mounted in the diffuser 12 for rotation therein. The impeller 13 has a plurality of circumferentially disposed fins 21 thereon for impingement of the jet of water passing through the slot 20 of the diffuser 12 thereon to cause rotation of the impeller 13. The slot 20 is placed so that the jet of water strikes a fin 21 near 90° to increase the rotational speed.

The impeller 13 also has three tabs 22 disposed circumferentially thereof and transverse to the fins 21 on a side facing the discharge cover 14. As illustrated in FIG. 1, each tab 22 spans two fins 21 and is of flat sector-shape. Alternatively, the impeller 13 may have any number of tabs so long as the tabs are circumferentially spaced apart. Likewise, each tab may span more than two fins 21.

The impeller 13 includes a cover 23 on a side opposite the tabs 22 to prevent water flow on the top of the impeller 13, as viewed, thereby helping to prevent resistance to rotation by water flow.

As illustrated in FIG. 1, the slot 20 in the circumferential wall 18 of the diffuser 12 extends from the bottom, as viewed, of the wall 18 to terminate at a point above the base 16 and the cover 23 of the impeller 13 is located out of the plane of the slot 20 such that the jet of water passing through the slot 20 contacts only a fin 21 and not the cover 23.

The discharge cover 14 is mounted on the housing 11 in facing relation to the impeller 13 and is of cup shape having a base 24 with three ports 25 for discharging water therethrough and a circumferential collar 26 for abutting the housing 11.

In this embodiment, the diffuser 12 functions as a means within the 14 cover for directing at least one jet of water onto the fins 21 of the impeller 13 to effect rotation of the impeller 13 within the cover 14 and for subsequent passage out of the ports 25 as jets of water.

By way of example, for a port 25 of a diameter of 0.039 inches and a flow rate into the spray head 10 of 1.2 gallons of water per minute (GPM) under a pressure of 60 psi, the velocity of a stream of water from a port 25 is about 107 feet per second (ft/sec).

The discharge cover 14 is of any suitable material, such as plastic, and an annular seal ring (not shown) is disposed in sealed relation between the circumferential wall 18 of the diffuser 12 and the base 24 of the discharge cover 14. A seal ring (not shown) may also be positioned between the housing 11 and the collar 26 of the discharge cover 14.

The ports 25 in the cover 14 are disposed relative to the tabs 22 of the impeller 13 whereby a respective tab 22 covers a respective port 25 to prevent passage of water therethrough during rotation of the impeller 13 while the other tabs 22 are spaced from the other ports 25 whereby two streams of water are discharged from the spray head 10 at all times during operation of the spray head 10.

Referring to FIG. 2, the parts of the spray head 10 are held together by a mounting screw 27 that passes through a central bore 28 in the cover 14, a central bore 29 in the impeller 13 and a central bore (not shown) in the diffuser 12 to threadably engage in an internally threaded support 30 fixed in the housing 11.

Typically, the pre-rinse spray head 10 is mounted on the end of a pre-rinse spray assembly that includes a manually operated handle for opening and closing a valve for delivering water to the spray head 10.

When in use, water enters the spray head 10 via the inlet 15, passes about the impeller 13 and flows as a continuous jet of water through the slot 20 in the impeller wall to impinge on a fin 21 of the impeller 13 to drive the impeller 13 into rotation while leaving as individual streams of water through the ports 25 in the discharge cover 14.

Continued rotation of the impeller 13 is caused by the jet of water impinging on further fins 21 being sequentially brought in line with the slot 20.

As the impeller 13 rotates, the tabs 22 move across the inlet to the ports 25 thereby momentarily closing off the ports 25 to the flow of water thereby creating pulsating streams of water from the ports 25. The tabs 22 are arranged relative to the ports 25 so that only one port 25 at a time is closed such that two streams of water are always flowing from the spray head 10. Alternatively, the tabs 22 may be arranged to close off two ports 25 at a time such that only one stream always flows from the spray head 10.

The pulsating streams of water provided by the spray head 10 are sufficient to effectively pre-rinse dishes, plates and similar china. In this regard, depending on the delivered rate of flow, the spray head 10 is able to deliver a pulsating spray of water of less than 1.2 gallons per minute.

Tests have indicated that the flow rate is less than 1.2 gallons per minute at a pressure of 60 psi, i.e. a flow rate of 1.11 gallons per minute.

Further, the cleanability performance of the spray valve is 26 seconds per plate or less based on the ASTM standards, Test Method for Performance of Pre-Rinse Spray Valve (ASTM-F23-24 Test Standards).

Figure 3:
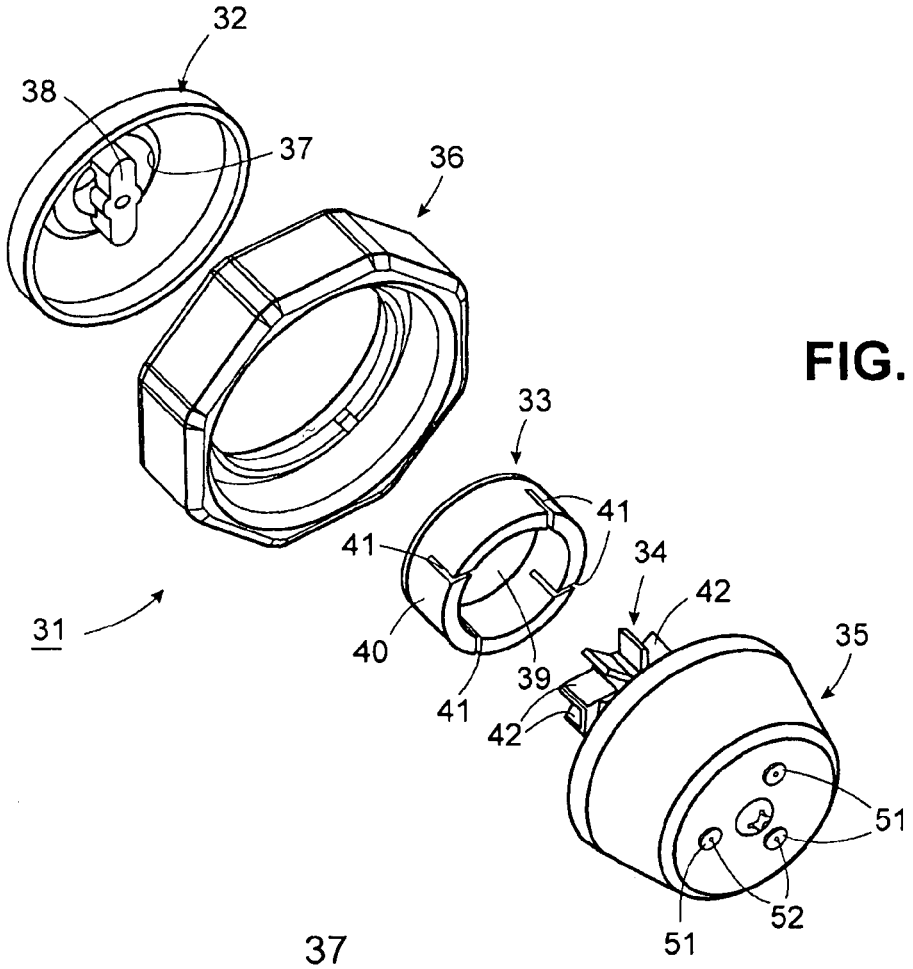
FIG. 3 illustrates an exploded view of a further spray head constructed in accordance with the invention.

Referring to FIG. 3, in another embodiment, the spray head 31 for a pre-rinse assembly comprises five basic parts, i.e. a retainer 32, diffuser 33, impeller 34, discharge cover 35 and rubber bumper 36.

Figure 4:
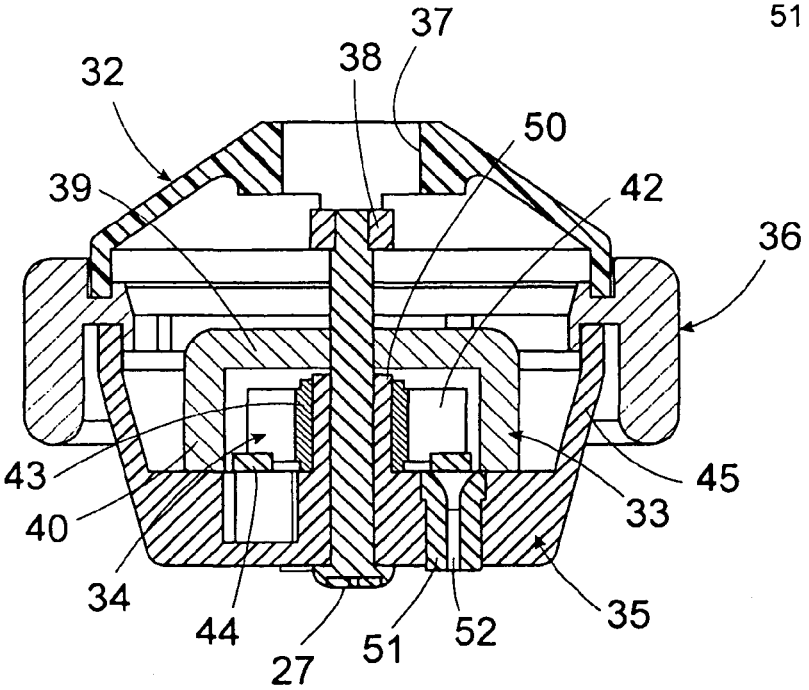
FIG. 4 illustrates a cross-sectional view of the spray head of FIG. 3.

Referring to FIGS. 3 and 4, the retainer 32 is of one piece of annular shape with a conical cross-section and has an inlet 37 at the apex for an inflow of water. In addition, the retainer 32 has an internally threaded support 38 that bridges across and under the inlet 37, as viewed.

The retainer 32 is made of any suitable material, such as plastic, stainless steel, chrome plated brass, and the like.

The diffuser 33, as the diffuser 12 of FIGS. 1 and 2, is fixedly disposed on the cover 35, for example, by ultrasonic weld, an adhesive such as a Loctite® adhesive, and is disposed on a longitudinal axis of the retainer 32. The diffuser 33 is made in one piece of a suitable material, such as a metal, plastic or composite.

Referring to FIG. 4, the diffuser 33 is disposed coaxially between the retainer 32 and the discharge cover 35. As above, the diffuser 33 has a base 39 defining a transverse chamber with the retainer 32 and being in communication with the inlet 36 for receiving the flow of water. The diffuser 33 also has a circumferential wall 40 extending from the base 39 defining an annular chamber with the discharge cover 35 and being in communication with the transverse chamber to receive the flow of water.

Referring to FIG. 3, the circumferential wall 40 of the diffuser 33 has a plurality of equi-spaced slots 41 that extend angularly therethrough and that are in communication with the annular chamber to direct individual jets of water therethrough.

The impeller 34 is mounted in the diffuser 33 for rotation therein and has a plurality of circumferentially disposed fins 42 thereon for impingement of the jets of water passing through the slots 41 of the diffuser 33 thereon to cause rotation of the impeller 34. As above, each slot 41 is placed so that the jet of water therefrom strikes a fin 42 near 90° to increase the rotational speed of the impeller 34.

Figure 6:
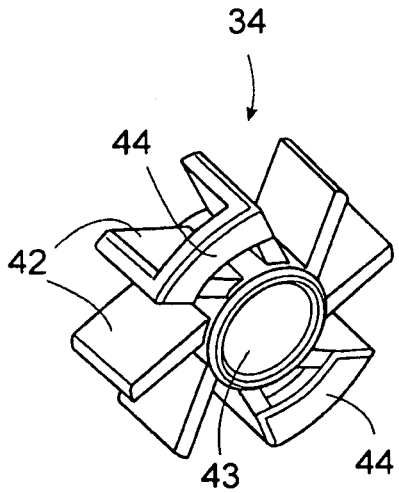
FIG. 6 illustrates a perspective view of an impeller constructed in accordance with the invention.

Referring to FIGS. 4 and 6, the fins 42 of the impeller 34 extend from a central hub 43 with each fin 42 at an acute angle relative to the hub 43. That is, each fin 42 does not extend radially at a 90° angle from the hub 43 in order for the jets of water passing through the slots 41 to impact perpendicularly on the fins 42 thereby making the impeller more easily rotatable.

The impeller 34 also has a pair of tabs 44 disposed circumferentially thereof and transverse to the fins 42 on a side facing the discharge cover 35. As illustrated in FIG. 4, each tab 44 is spaced from the cover 35 to allow the impeller 34 to rotate at a very low flow rate.

As illustrated in FIG. 6, wherein like reference characters indicate like parts as above, each tab 44 spans two fins 42 and is of flat sector-shape. In addition, the two tabs 44 are diametrically spaced apart on the impeller 34.

Unlike the impeller 13 of the embodiment of FIGS. 1 and 2, the impeller 34 does not have a cover on a side opposite the tabs 44 in order to simplify the manufacture of the impeller 34.

Figure 5:
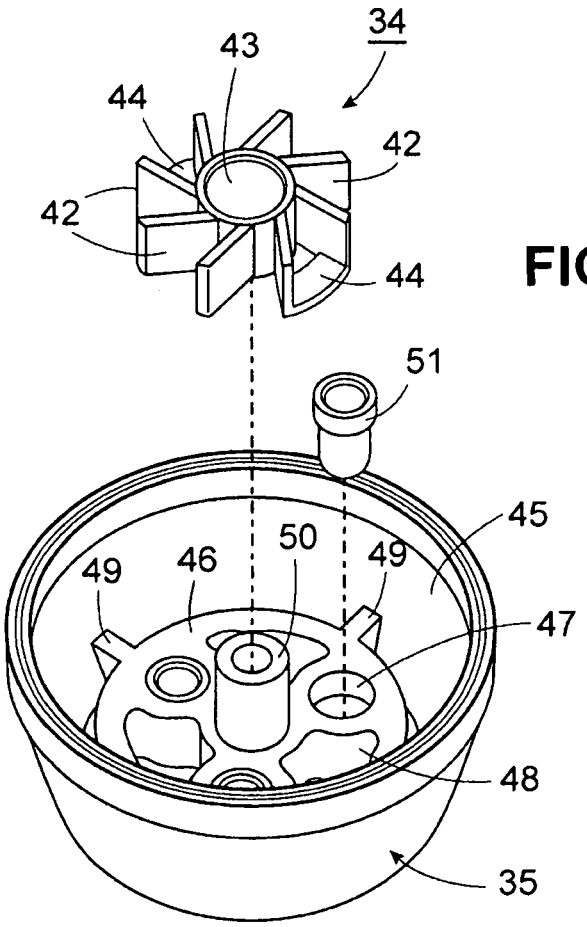
FIG. 5 illustrates an exploded view of the discharge cover, impeller and one insert of the spray head of FIG. 3.

Referring to FIGS. 4 and 5, the discharge cover 35 is mounted coaxially of the retainer 32 and is made of any suitable material, such as a plastic, and is in one-piece construction. The discharge cover 35 is of cup-shape with a peripheral wall 45 concentric to the circumferential wall 40 of the diffuser 33 to define an annular chamber therebetween. In addition, the discharge cover 35 has a centrally disposed circular pedestal 46 provided with three equi-spaced circumferentially disposed ports 47, recesses 48 between the ports 47 and radial ribs 49 extending to the wall 46 for reinforcing the pedestal 46.

The discharge cover 35 also has a centrally disposed upstanding post 50 extending from the pedestal 46. The post 50 is of a uniform diameter to receive the hub 43 of the impeller 33 with a small clearance therebetween so that the impeller 33 is free to rotate about the post 50. In addition, the post 50 terminates with a slight gap from the inside surface of the base 39 of the diffuser 33.

Referring to FIGS. 4 and 5, the discharge cover 35 is also provided with a plurality of inserts 51, each of which is disposed in a respective port 47 and each of which has an orifice 52 for discharging a jet of water therethrough.

Referring to FIG. 4, as above the parts of the spray head 10 are held together by a mounting screw 27 that passes through a central bore in the cover 35, a central bore in the hub 43 of the impeller 34 and a central bore (not shown) in the diffuser 33 to threadably engage in an internally threaded support 38 fixed in the retainer 32.

Referring to FIG. 5, each insert 51 is of tubular shape with a stepped cross-section to fit into a respective port 47. To this end, each port 47 has a stepped cross-section with a lower portion, as viewed, receiving a lower portion of an insert 51 and an upper portion of larger diameter receiving an upper portion of the insert 51. When in place, the top surface of an insert 51 is flush with the top surface of the pedestal 46 and the bottom of the insert 51 projects slightly from the face 53 of the discharge cover 35.

During operation of the spray head 31, a flow of water passing through the inlet 37 of the retainer 32 passes about the diffuser 33 and flows through the slots 41 forming jets of water that impinge on the fins 42 of the impeller 34 before passing out of the orifices 52 of the inserts 51.

Impingement of the jets of water on the fins 42 also causes the impeller 34 to rotate. Thus, each tab 44 of the rotating impeller 34 momentarily covers a respective port 47 and insert 51 therein to prevent passage of water therethrough and thereby causes a pulsating stream of water to emanate from the orifice 52 of the insert 51.

Since the discharge cover 35 has three ports 47 and the impeller 34 has two tabs 44, when one port 47 is blocked, the other two ports 47 are not blocked so that at least two pulsating streams of water are discharged from the spray head 31 at all times during operation of the spray head.

Where the discharge cover 35 has two ports 47 diametrically spaced apart (not shown) and the impeller 34 has two tabs 44 diametrically spaced apart, the resulting two streams of water that are discharged from the spray head 31 are pulsed at the same time rather than being staggered.

Tests have shown that for a flow rate of 1.2 GPM at a pressure of 60 psi, the velocity of a jet of water from an orifice 52 of an insert 51 were as follows:

For an orifice of 0.033 inches, the velocity at a port 52 was about 149 ft/sec.

For an orifice of 0.041 inches, the velocity at a port 52 was about 97 ft/sec.

For an orifice of 0.042 inches, the velocity at a port 52 was about 92 ft/sec.

Other tests have shown that at a pressure of 60 psi, a spray head with ports 52 of a diameter of 0.033 inches produced a flow rate of 0.24 GPM; a spray head with ports 52 of a diameter of 0.041 inches produced a flow rate of 0.37 GPM; and a spray head with ports 52 of a diameter of 0.042 inches produced a flow rate of 0.40 GPM;

The invention thus provides a spray head for a pre-rinse spray head assembly that minimizes water consumption and that produces pulsating streams of water at high velocity.

What is claimed is:

1. A spray head for a pre-rinse assembly comprising a discharge cover having a plurality of circumferentially disposed ports for discharging water therethrough;

an impeller rotatably mounted within said cover, said impeller having a plurality of circumferentially disposed fins thereon and a plurality of tabs disposed circumferentially thereof and transverse to said fins, said tabs being disposed relative to said ports whereby a respective tab momentarily covers a respective port to prevent passage of water therethrough and from said discharge cover during rotation of said impeller while the other of said tabs are spaced from the other of said ports to allow passage of water therethrough and from said discharge cover; and means within said cover for directing at least one jet of water onto said fins of said impeller to effect rotation of said impeller within said cover and for subsequent passage out of said ports as jets of water, said means including a cup-shaped diffuser secured to and concentrically within said discharge cover, said diffuser having a base spaced from said discharge cover and a circumferential wall extending from said base and abutting said discharge cover, said wall having at least one slot extending angularly therethrough for directing a jet of water therethrough into said diffuser.

2. A spray head as set forth in claim 1 wherein said slot is placed so that the jet of water strikes a fin of said fins at an angle near 90°.

3. A spray head as set forth in claim 1 further comprising a housing coaxial with said discharge cover and concentric to said diffuser to define to a transverse chamber with said base and an annular chamber with said circumferential wall, said housing having an inlet for a flow of water into said transverse chamber and said annular chamber.

4. A spray head as set forth in claim 3 further comprising a mounting screw passing through said discharge cover, said impeller and said diffuser to threadably engage in said housing for securing said discharge cover to said housing.

5. A spray head as set forth in claim 1 wherein said discharge cover has a peripheral wall concentric to said circumferential wall of said diffuser to define an annular chamber therebetween.

6. A spray head as set forth in claim 5 further comprising a retainer coaxial with said discharge cover and spaced from said diffuser to define a transverse chamber therebetween in communication with said annular chamber, said retainer having an inlet for a flow of water into said transverse chamber.

7. A spray head as set forth in claim 6 further comprising an annular rubber bumper secured between said retainer and said peripheral wall of said discharge cover in sealed relation thereto and projecting therefrom.

8. A spray head as set forth in claim 7 further comprising a mounting screw passing through said discharge cover, said impeller, said diffuser and said bumper to threadably engage in said retainer for securing said discharge cover to said retainer.

9. A spray head as set forth in claim 1 wherein said discharge cover has three ports and said impeller has three tabs whereby two streams of water are discharged from the spray head at all times during operation of the spray head.

10. A spray head as set forth in claim 1 wherein said discharge cover has two ports and said impeller has two tabs.

11. A spray head as set forth in claim 1 further comprising a plurality of inserts, each said insert being disposed in a respective one of said ports of said discharge cover and having an orifice therein for discharging a jet of water therethrough.

12. A spray head for a pre-rinse assembly comprising a housing having an inlet for a flow of water;

a diffuser disposed in said housing on a longitudinal axis of said housing, said diffuser having a base disposed in said housing to define a transverse chamber therebetween in communication with said inlet for receiving the flow of water and a circumferential wall extending from said base to define an annular chamber therebetween in communication with said transverse chamber to receive the flow of water, said wall having a slot extending angularly therethrough and being in communication with said annular chamber to direct a jet of water therethrough;

an impeller mounted in said diffuser for rotation therein, said impeller having a plurality of circumferentially disposed fins thereon for impingement of the jet of water passing through said slot thereon to cause rotation of said impeller, said impeller having three tabs disposed circumferentially thereof and transverse to said fins; and a discharge cover mounted on said housing in facing relation to said impeller, said cover having three ports for discharging water therethrough, said ports being disposed relative to said tabs whereby a respective tab covers a respective port to prevent passage of water therethrough during rotation of said impeller while the other of said tabs are spaced from the other of said ports whereby two streams of water are discharged from the spray head at all times during operation of the spray head.

13. A spray head as set forth in claim 12 further comprising an annular seal ring disposed in sealed relation between said circumferential wall of said diffuser and said discharge cover.

14. A spray head as set forth in claim 12 wherein said diffuser is fixedly mounted in said housing.

15. A spray head for a pre-rinse assembly comprising a retainer having an inlet for a flow of water;

a discharge cover mounted coaxially of said retainer and having a plurality of ports for discharging water therethrough, a diffuser disposed coaxially between said retainer and said discharge cover, said diffuser having a base defining a transverse chamber with said retainer and in communication with said inlet for receiving the flow of water and a circumferential wall extending from said base defining an annular chamber with said discharge cover and in communication with said transverse chamber to receive the flow of water, said wall having at least one slot extending angularly therethrough and being in communication with said annular chamber to direct a jet of water therethrough;

an impeller mounted in said diffuser for rotation therein, said impeller having a plurality of circumferentially disposed fins thereon for impingement of the jet of water passing through said slot thereon to cause rotation of said impeller, said impeller having a plurality of tabs disposed circumferentially thereof and transverse to said fins, said tabs being disposed relative to said ports whereby a respective tab momentarily covers a respective port to prevent passage of water therethrough during rotation of said impeller thereby effecting a pulsating stream of water through said respective port.

16. A spray head as set forth in claim 15 wherein said discharge cover has three ports and said impeller has three tabs whereby two streams of water are discharged from the spray head at all times during operation of the spray head.

17. A spray head as set forth in claim 15 wherein said discharge cover has two ports and said impeller has two tabs.

18. A spray head as set forth in claim 15 further comprising an annular rubber bumper secured between said retainer and said discharge cover in sealed relation thereto and projecting therefrom.

19. A spray head as set forth in claim 18 further comprising a mounting screw passing through said discharge cover, said impeller, said diffuser and said bumper to threadably engage in said retainer for securing said discharge cover to said retainer.

20. A spray head as set forth in claim 15 wherein said diffuser is fixedly secured to said discharge cover.

21. A spray head as set forth in claim 15 further comprising a plurality of inserts, each said insert being disposed in a respective one of said ports of said discharge cover and having an orifice therein for discharging a jet of water therethrough.

* * * * *